US007581345B2

(12) United States Patent
McGarry

(10) Patent No.: US 7,581,345 B2
(45) Date of Patent: Sep. 1, 2009

(54) METHOD FOR BLOCKING DISCHARGE OF FIREARM

(75) Inventor: James McGarry, Prescott Valley, AZ (US)

(73) Assignee: Sturm, Ruger & Company, Inc., Southport, CT (US)

( * ) Notice: Subject to any disclaimer, the term of this patent is extended or adjusted under 35 U.S.C. 154(b) by 0 days.

(21) Appl. No.: 12/074,780

(22) Filed: Mar. 6, 2008

(65) Prior Publication Data

US 2008/0148618 A1 Jun. 26, 2008

Related U.S. Application Data

(62) Division of application No. 10/825,516, filed on Apr. 15, 2004, now Pat. No. 7,360,331.

(51) Int. Cl.
*F41A 17/00* (2006.01)

(52) U.S. Cl. ..... 42/70.02; 42/70.11; 89/148

(58) Field of Classification Search ..... 42/70.02, 42/70.11; 89/148

See application file for complete search history.

(56) References Cited

U.S. PATENT DOCUMENTS 3,750,319 A * 8/1973 Roy ..... 42/70.08
3,750,531 A * 8/1973 Angell et al. ..... 89/148
3,857,325 A * 12/1974 Thomas ..... 89/138
4,709,496 A * 12/1987 Johnson ..... 42/70.11
4,761,906 A * 8/1988 Guevara ..... 42/70.11
5,438,784 A * 8/1995 Lenkarski et al. ..... 42/70.02
6,256,920 B1 * 7/2001 Olson ..... 42/70.11
6,415,702 B1 * 7/2002 Szabo et al. ..... 89/148
6,519,887 B1 * 2/2003 Allen et al. ..... 42/70.02
7,240,449 B2 * 7/2007 Clifton, Jr. ..... 42/70.11

* cited by examiner

*Primary Examiner*—Michelle Clement
(74) *Attorney, Agent, or Firm*—Duane Morris, LLP

(57) ABSTRACT

An autoloading pistol with a magazine disconnect mechanism that blocks discharge of the pistol when the magazine is removed by action upon the pistol's firing pin. The pistol may generally include a removable magazine, a housing defining a chamber to hold a cartridge, and a firing pin movable towards the chamber. The magazine disconnect mechanism includes a blocking member which may be movably disposed in the housing, and is movable into and out of engagement with the firing pin. In one embodiment, an actuator may be provided that controls the position of the blocking member and is movable in response to the insertion and removal of the magazine from the pistol. The actuator in a possible first position disengages the blocking member from the firing pin when the magazine is inserted in the pistol to allow the pistol to be discharged. The actuator in a possible second position engages the blocking member with the firing pin when the magazine is removed from the pistol to prevent the firing pin from moving forward toward the chamber. In one embodiment, the actuator may be an ejector that also ejects spent cartridges from the pistol after discharging the pistol.

12 Claims, 13 Drawing Sheets

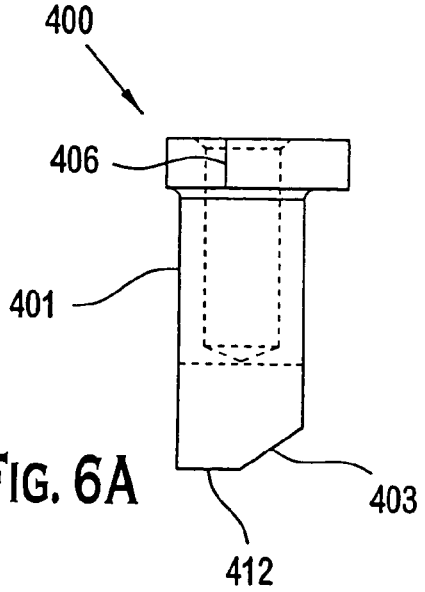
FIG. 6A
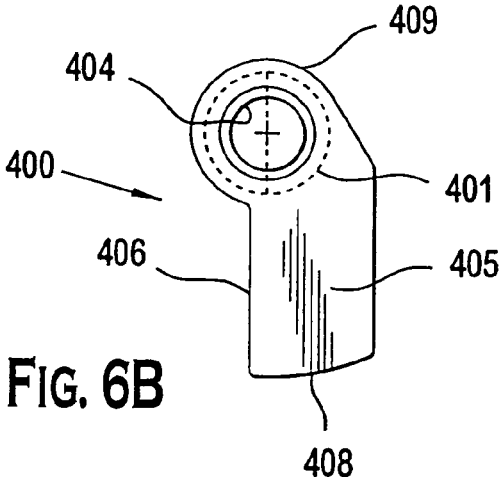
FIG. 6B
FIG. 6
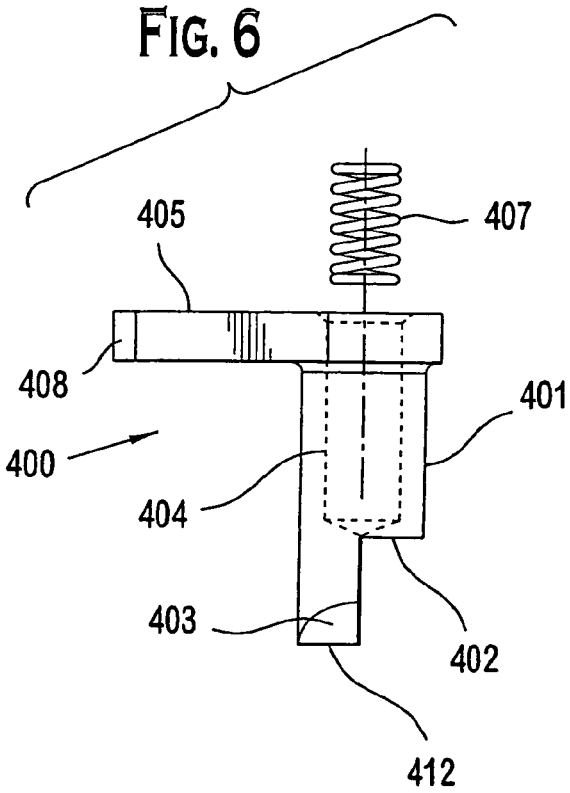
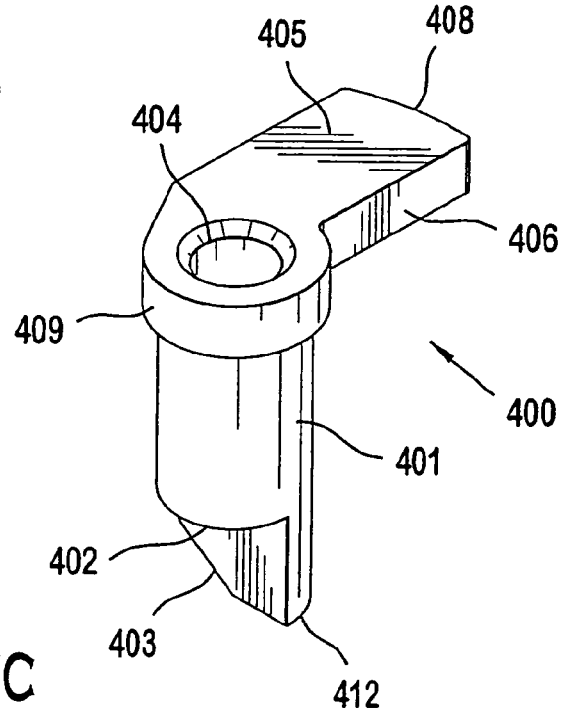
FIG. 6C

FIG. 13A
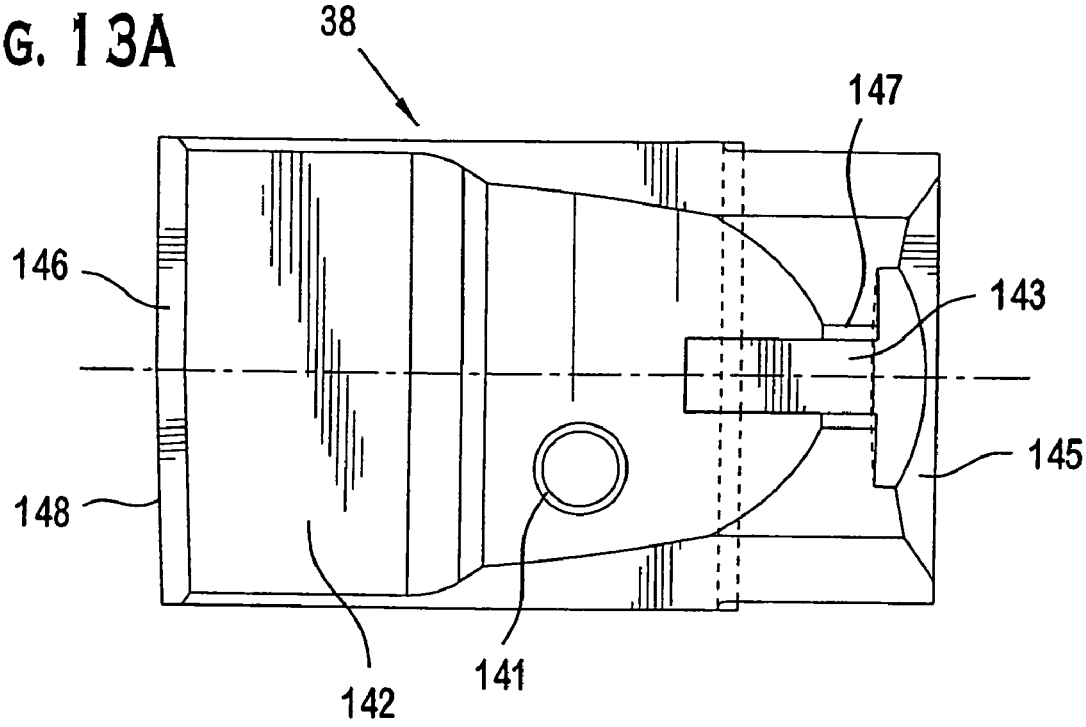
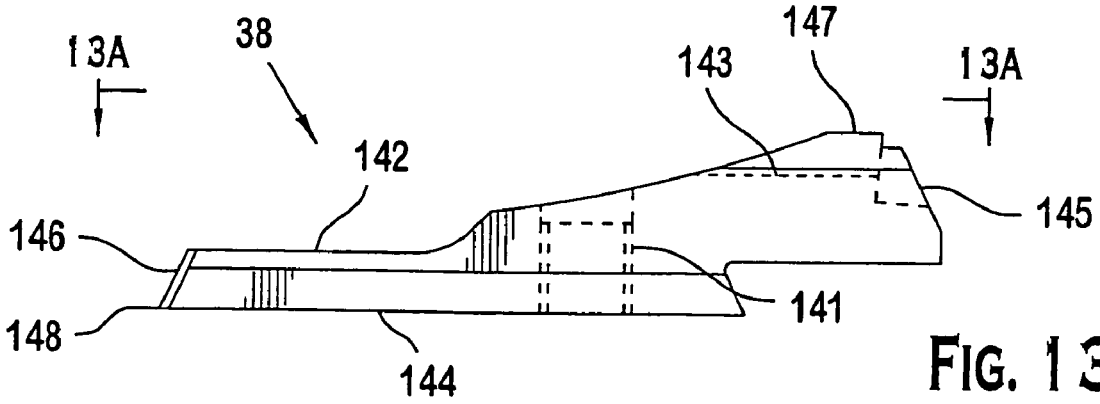
FIG. 13

FIG. 15
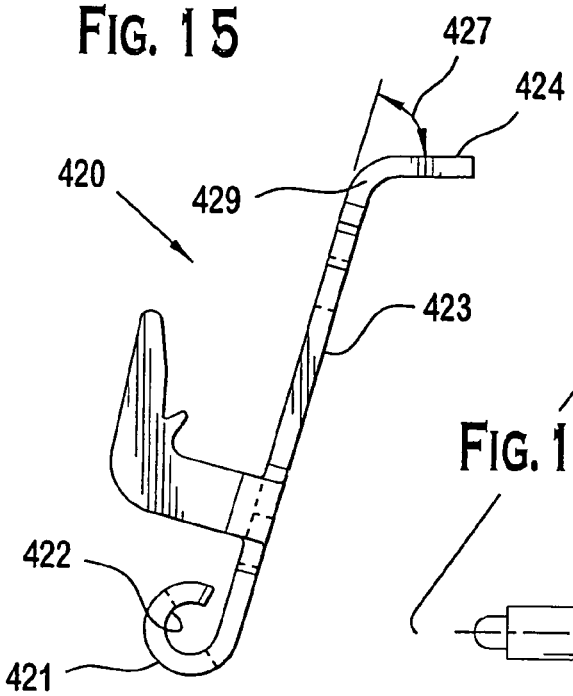
FIG. 15A
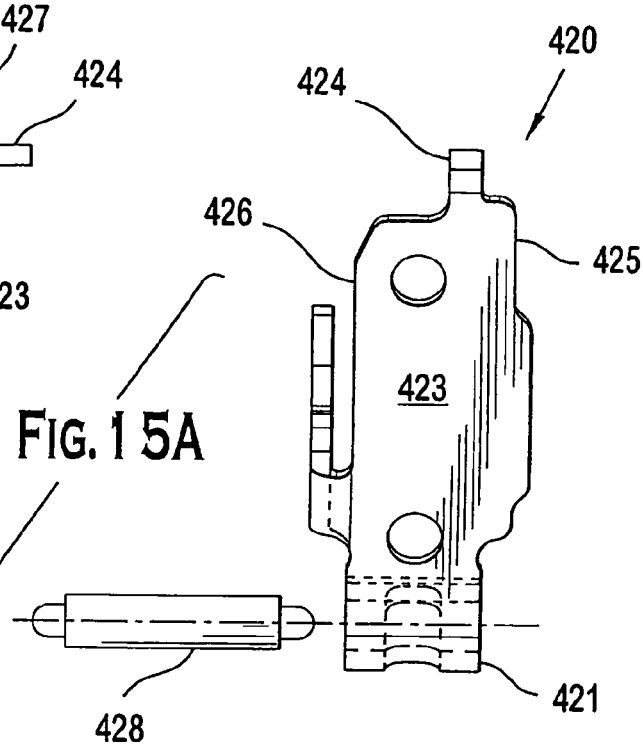
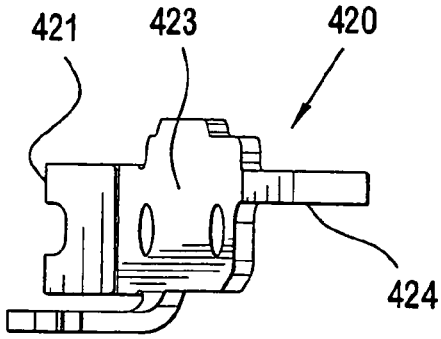
FIG. 15B
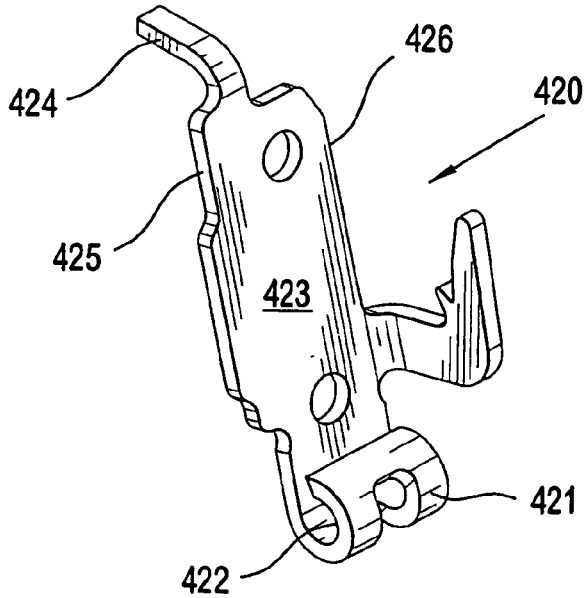
FIG. 15C

METHOD FOR BLOCKING DISCHARGE OF FIREARM

CROSS-REFERENCE TO RELATED APPLICATIONS

This is a divisional of and claims priority to U.S. patent application Ser. No. 10/825,516 filed Apr. 15, 2004, entitled "Pistol with Firing Pin Blocking Magazine Disconnect Mechanism," which is incorporated herein by reference in its entirety.

BACKGROUND OF THE INVENTION

The present invention generally relates to firearms, and more particularly to a magazine disconnect mechanism for autoloading pistols that disables the pistol's discharge capability when the magazine removed.

In autoloading pistols utilizing removable cartridge magazines, a cartridge may still remain chambered after the magazine has been removed. Although the loaded chamber condition of a pistol's chamber is customarily and most positively checked by user opening the action and visually observing the presence of a cartridge therein, prior devices are known that attempt to augment this procedure by alternatively disabling certain portions of a pistol's trigger assembly so that the pistol cannot be discharged when the magazine is removed. The trigger assembly typically includes a trigger, a trigger bar, and a hammer which contacts a firing pin that strikes a chambered cartridge. One approach used in a known magazine disconnect devices has been to arrest movement of the trigger linkage connected to the hammer. For example, when the magazine is removed in one known device disclosed in U.S. Pat. No. 6,240,669 to Spaniel et al., an open-topped slot in the trigger bar receives and engages a downwardly spring-loaded lug to block the trigger bar and trigger connected thereto from being moved in response to an attempted trigger pull. When the magazine is reinserted in the pistol, the lug is contacted and displaced upwards by the magazine to disengage the lug from the slot.

All the foregoing magazine disconnect devices may be circumvented by the user in certain instances. For example, it may be possible to defeat the lug and trigger bar slot device by partially pulling the trigger before fully withdrawing the magazine. This would cause the trigger bar to move slightly forward, so that the lug would not be aligned with and seat in the trigger bar slot when the magazine is subsequently completely removed. The trigger could then be fully pulled and a cartridge if remaining in the chamber may be discharged. In addition, parts in these type devices such as the slot, lug, and often long and circuitous biasing springs are prone to wear and breakage which may render these magazine disconnects ineffective. Moreover, none of the known disconnect devices arrest movement of the pistol's firing pin.

Accordingly, there is a further need for an improved magazine disconnect that overcomes the shortcomings of the prior devices and disables the pistol's discharge capability when the magazine removed.

SUMMARY OF THE INVENTION

A movable magazine disconnect mechanism for an autoloading pistol is provided that is responsive to removal and insertion of the magazine from the pistol and disables the pistol so that it cannot be discharged without the magazine present. In the preferred embodiment, the magazine disconnect mechanism arrests the forward motion of the firing pin without the magazine present so that the firing pin cannot be advanced sufficiently forward to strike the cartridge by a trigger pull or other action. This prevents discharge of the pistol should a cartridge remain in the chamber after the magazine has been removed. The preferred embodiment further cannot be circumvented by a partial trigger pull like known magazine disconnect devices. In addition, the preferred embodiment utilizes a relatively short and simple helical spring as a biasing member in contrast to the long and circuitous springs often used in the prior art. In a preferred embodiment, the magazine disconnect mechanism advantageously utilizes the ejector which serves a dual purpose of both expelling spent cartridges from the pistol, and functioning as an actuator for the disconnect mechanism to disable the discharging capability of the pistol when the magazine is removed.

A preferred embodiment of a pistol having a magazine disconnect mechanism generally includes a frame having a grip portion defining a downwardly open cavity that receives and removably holds a magazine containing cartridges, a housing defining a longitudinal axis for the pistol, a chamber defined in the housing to receive a cartridge, a barrel unit, a firing pin disposed in the housing and movable in a forward longitudinal direction towards the chamber to strike a chambered cartridge, an ejector to expel spent cartridges from the pistol after discharge, a magazine disconnect mechanism operably associated with the magazine, and a trigger assembly generally including a trigger, trigger bar, and hammer mechanically coupled together for operably coupled movement. In one embodiment, the housing may be a slide that is slidably mounted on the frame and movable in a reciprocating manner in the direction of the longitudinal axis. The slide moves rearwards in response to recoil forces developed by discharging the pistol, and is returned to a forward position by a recoil spring.

The magazine disconnect mechanism in the preferred embodiment includes a blocking member and a blocking member actuator that is operably responsive to inserting and removing the magazine from the pistol. In one embodiment, the blocking member actuator may be a lever which is pivotally connected to the frame of the pistol. Preferably, the lever is positioned in the pistol to be operably contacted by the magazine so that it is movably responsive to inserting and removing the magazine from the pistol. Accordingly, the blocking member actuator is preferably activated by contact with and breaking contact with the magazine as it is either inserted or removed from the pistol.

Preferably, the blocking member actuator is operably coupled, either directly or indirectly through intermediate components, to the blocking member and controls the movement and position of the blocking member. The blocking member may include a body which may be structured as a plate and a lever arm protruding therefrom to engage the blocking member. In one embodiment, the lever arm may be angularly disposed to the body and configured to engage the blocking member when both components are mounted in the pistol. When the magazine is inserted in the pistol, the blocking member actuator may in one embodiment be located behind the magazine with the lever arm extending above and in a forward direction over the magazine to contact the blocking member. In one embodiment, the blocking member actuator may be vertically movable from an up position to a down position. In the preferred embodiment, the ejector also advantageously serves as the actuator for the blocking member, thereby eliminating the need for a separate component that performs the function of a blocking member actuator.

The blocking member preferably is moveable in position, by the blocking member actuator, into and out of engagement with the firing pin in response to the absence or presence of the magazine in the pistol, respectively. In the preferred embodiment, the blocking member is movable from a first position disengaged from the firing pin when the magazine is present and inserted in the pistol, to a second position engaged with the firing pin when the magazine is absent and removed from the pistol. Preferably, the blocking member is vertically movable in an upward and downward direction, and in one embodiment engages the top of the firing pin. In one embodiment, a biasing member such as a helical spring may be provided to bias or urge the blocking member downward into engagement with the firing pin when the magazine is removed from pistol. When in a position engaged with the firing pin, the blocking member arrests or blocks the forward motion of the firing pin to prevent the firing pin from reaching and striking the cartridge. Preferably, the blocking member is disposed inside the pistol housing.

In one embodiment, the blocking member includes a generally cylindrical mounting portion in the form of a shaft and a firing pin engagement portion in the form of laterally-extending planar flange preferably disposed perpendicular to the shaft and having a surface to contact and engage the firing pin. Preferably, the shaft is oriented in a vertical direction and located proximate and lateral to the firing pin so that the flange extends laterally over the firing pin. In one embodiment, the blocking member is configured and positioned to engage the top of the firing pin. The shaft and flange, which may be an integral part of the shaft, is preferably vertically movable in an upward and downward direction into and out of engagement with the firing pin, respectively.

The preferred embodiment of a magazine disconnect mechanism advantageously prevents the mechanism from being defeated by a partial trigger pull like the prior art. Because the magazine disconnect mechanism preferably engages and arrests movement of the firing pin when the magazine is removed, the firing pin will not advance forward toward a chambered cartridge even if a cocked hammer were somehow released after the magazine has been removed. Once the magazine is removed, the blocking member actuator, which may be the ejector in one embodiment, drops allowing the spring-biased blocking member to fall into engagement with the firing pin to arrest its movement until the magazine is reinserted into the pistol.

In one embodiment, a pistol with magazine disconnect mechanism includes a frame that removably holds a magazine, a housing carried by the frame and defining a chamber to hold a cartridge, a firing pin disposed in the housing and movable toward the chamber to contact a chambered cartridge, and a blocking member movable into and out of engagement with the firing pin. In one embodiment, the housing is a reciprocating slide movable in a forward and rearward direction, and the blocking member may be disposed in the movable slide. In another embodiment, the blocking member may be vertically movable from a first position in which the blocking member does not engage the firing pin to a second position in which the blocking member engages the firing pin. A biasing member may be provided to bias the blocking member into the second position. A blocking member actuator is further provided that is movable in response to inserting and removing a magazine from the pistol. The actuator operably disengages the blocking member from the firing pin when the magazine is inserted into the pistol, and the actuator operably engages the blocking member with the firing pin when the magazine is removed from the pistol to prevent the firing pin from moving toward and contacting the chambered cartridge. In another embodiment, the magazine releasably contacts and moves the actuator in a first direction to disengage the blocking member from the firing pin. In yet another embodiment, the magazine breaks contact with and moves the actuator in a second direction to engage the blocking member with the firing pin.

Another embodiment of a pistol with a magazine disconnect mechanism includes a frame defining a downwardly open cavity, a magazine removably inserted in the cavity, a reciprocating slide carried by the frame and defining a chamber to hold a cartridge, and a firing pin movable towards the chamber to contact a chambered cartridge and discharge the pistol. The pistol further includes a blocking member engageable with the firing pin and movable between a first position in which the blocking member does not engage and block forward movement of the firing pin, and a second position in which the blocking member engages and blocks forward movement of the firing pin. The blocking member may be movable in a vertical direction between the first and second positions in one embodiment. A movable blocking member actuator is provided that is supported in place by the inserted magazine and holds the blocking member in the first position. Removing the magazine from the pistol and support for the blocking member actuator displaces the blocking member actuator in a first direction to concomitantly engage the blocking member with the firing pin in the second position to prevent discharging the pistol. In one embodiment, reinserting the magazine into the pistol displaces the actuator in a second direction which concomitantly returns the blocking member to the first position. In another embodiment, a biasing member is provided that biases the blocking member into the second position. In yet another embodiment, the actuator may have a body and angularly protruding lever arm configured to contact the blocking member. The blocking member actuator may be an ejector in another embodiment that ejects spent cartridges from the pistol. In one embodiment, the blocking member actuator maintains contact with the blocking member when the blocking member is in the first and second positions.

Yet another embodiment of a pistol with magazine disconnect mechanism includes a frame defining a downwardly open cavity, a magazine removably disposed in the cavity, a reciprocating slide defining a chamber to hold a cartridge, a firing pin disposed in the slide and movable in a forward direction towards the chamber to strike a chambered cartridge and discharge the pistol, and a blocking member engageable with the firing pin and movable between a first disengaged position in which the blocking member does not prevent the firing pin from striking the cartridge, and a second engaged position in which the blocking member prevents the firing pin from striking the cartridge. Preferably, a biasing member is provided that urges the blocking member into the second position. A blocking member actuator is provided that is operably coupled to the blocking member, the actuator movably responsive to inserting and removing the magazine from the pistol. In operation, inserting the magazine releasably contacts and displaces the actuator in a first direction to simultaneously move the blocking member into the first position against the urging of the biasing member. Removing the magazine breaks contact between the magazine and actuator, with the biasing member urging the blocking member into the second position and simultaneously displacing the actuator in a second direction opposite the first direction. Preferably, the actuator returns to a former position coinciding with its location prior to inserting the magazine into the pistol. In one embodiment, the actuator is pivotally mounted and movable in the frame, and includes a lever arm to operably engage the blocking member. In another embodiment, the blocking member is vertically movable between the first and second positions. In yet another embodiment, the actuator is vertically movable between an up position with the magazine inserted in the pistol and a down position with the magazine removed from the pistol. In one embodiment, the actuator is an ejector that expels spent cartridges from the pistol after discharge.

A method of blocking discharge of a pistol having a housing defining a longitudinal axis, a chamber to hold a cartridge, a firing pin, and a removable magazine held in a frame. The method includes the steps of removing the magazine from the pistol, engaging the longitudinally movable firing pin, and blocking the firing pin from moving into contact with a cartridge loaded in the chamber of the pistol. In another embodiment, the method further includes reinserting the magazine into the pistol, and disengaging the firing pin, and unblocking movement of the firing pin to contact the cartridge.

As the terms are used herein, the "front" of a pistol is defined as the barrel end and the "rear" of a pistol is defined as the handle or grip end. With the barrel positioned parallel to the ground, the term "top" in reference to the pistol is defined as the upper portion generally containing the aiming sight. The term "bottom" in reference to the pistol is defined as the lower portion generally containing the trigger. The "left side" of a pistol is defined as the side visible when the barrel points towards the left and the "right side" is the side visible when the barrel points to the right. Also as the terms may be used herein with respect to orientation using the pistol as a frame of reference to direction, "forward" indicates a direction towards the muzzle (front of barrel) end of the pistol and "rearward" indicates a direction towards the handle or grip end of the pistol. "Downwards" indicates a direction towards the bottom or underside of the pistol and "upwards" indicates a direction towards the top of the pistol opposite the bottom or underside. "Behind" indicates a location or position to the rear.

Although the preferred embodiment of a magazine disconnect mechanism is particularly suited for use with pistols that utilize centerfire-type ammunition, the preferred embodiment may be beneficially used in rimfire cartridge-type pistol applications as well.

BRIEF DESCRIPTION OF THE DRAWINGS

The features of the preferred embodiments will be described with reference to the following drawings where like elements are labeled similarly, and in which:

FIG. 6 is a front view of the firing pin blocking member of the pistol of FIG. 1;

FIG. 6A is a right side view of the firing pin blocking member of the pistol of FIG. 1;

FIG. 6B is a top view of the firing pin blocking member of the pistol of FIG. 1;

FIG. 6C is a perspective view of the firing pin blocking member of the pistol of FIG. 1;

FIG. 13 is a left side view of the rear sight of the pistol of FIG. 1;

FIG. 13A is a top view of the rear sight of the pistol of FIG. 1;

FIG. 15 is a right side view of the ejector of the pistol of FIG. 1;

FIG. 15A is a front view of the ejector of the pistol of FIG. 1;

FIG. 15B is a top view of the ejector of the pistol of FIG. 1; and

FIG. 15C is a perspective view of the ejector of the pistol of FIG. 1.

DESCRIPTION OF THE PREFERRED EMBODIMENTS

Figure 1:
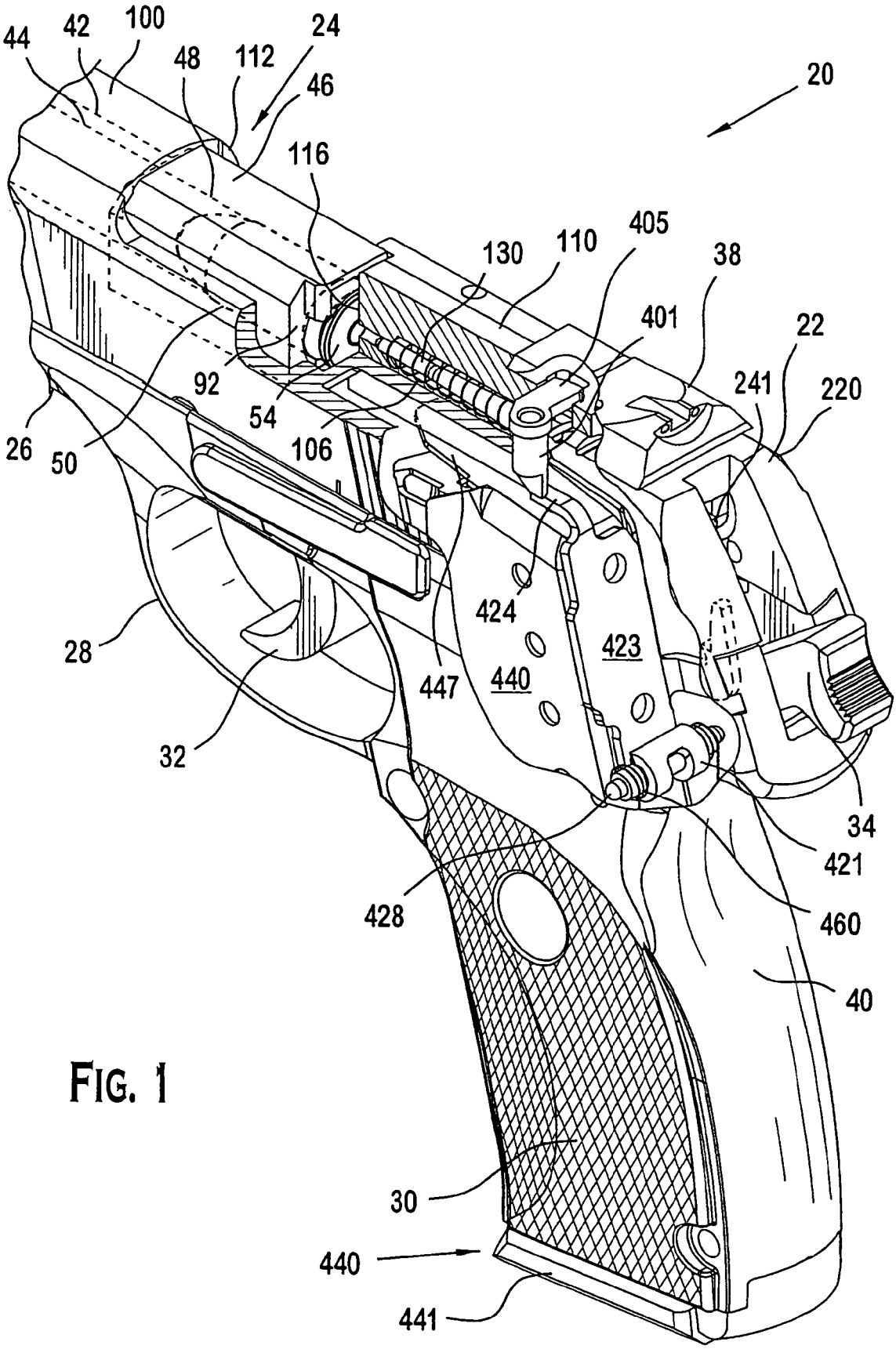
FIG. 1 is a perspective view of one embodiment of a firearm in the form of a pistol having a magazine disconnect mechanism and in which a portion of the exterior of the pistol has been removed to reveal part of the mechanism.

A preferred embodiment of pistol having a magazine disconnect mechanism will now be described for convenience with reference to a centerfire-type pistol in the form of an auto-loading pistol as shown in the drawings that uses centerfire cartridges (i.e., primer located in center of base of cartridge). It will be appreciated that other embodiments of the magazine disconnect mechanism may be made that are suitable for use with other type autoloading pistols and the invention is not limited to the description of the preferred embodiment described herein.

Figures 2, 3:
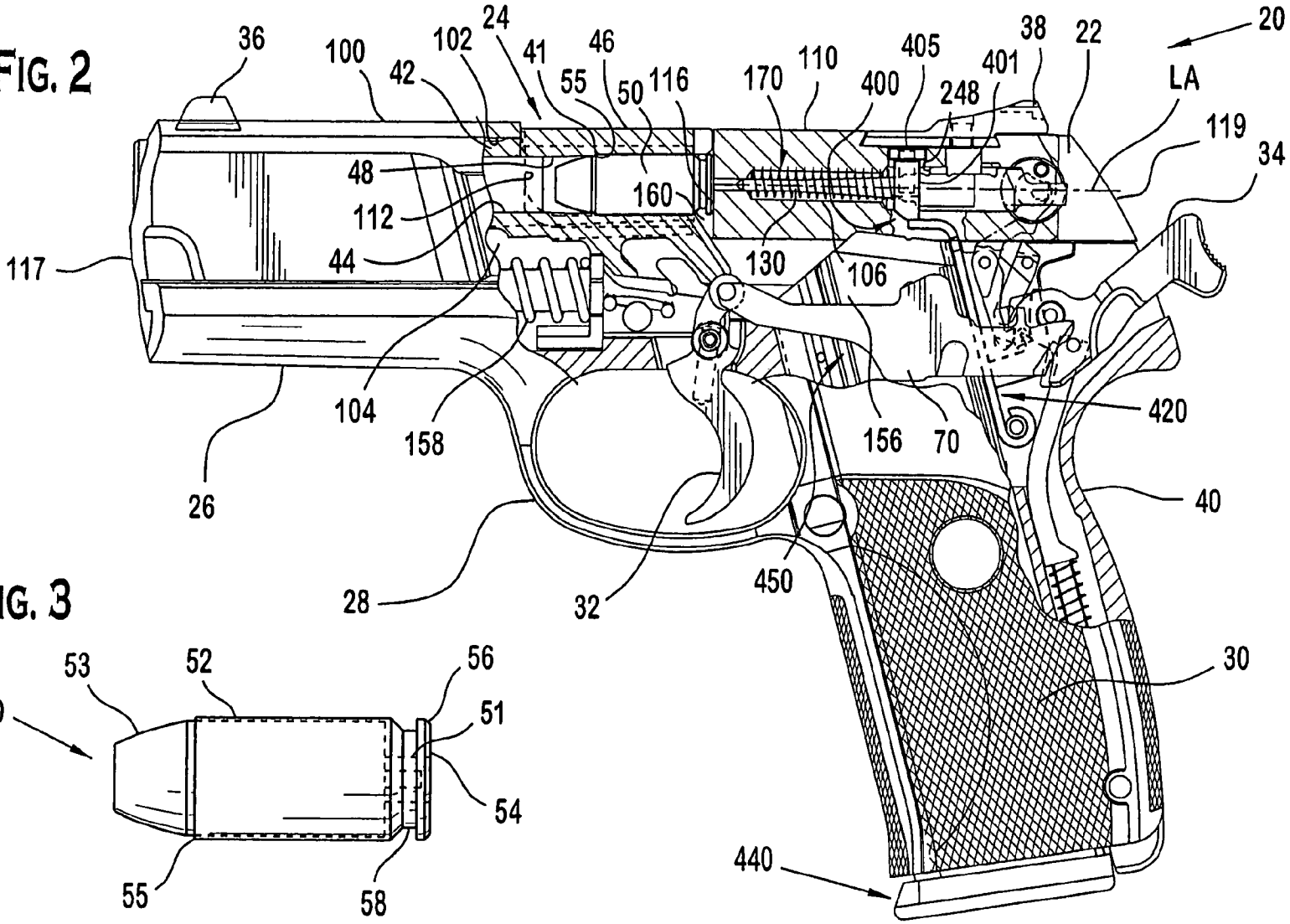
FIG. 2 is a side elevational view of the pistol of FIG. 1 with part of the exterior of the pistol removed to reveal the inner workings of the pistol.
FIG. 3 illustrates a self-contained cartridge useable with the pistol of FIG. 1.

Referring generally to FIGS. 1-2, a pistol 20 includes: a frame 26 having a trigger guard 28, grip frame 40 and a hand grip 30 mounted thereon; an elongated housing such as slide 22 carried by frame 26; a barrel unit 24 defining chamber 48 in the slide to receive a cartridge 50; a firing pin 130 disposed in the slide and movable in a longitudinal rearward direction and forward longitudinal direction towards the chamber to strike a chambered cartridge; a magazine disconnect mechanism including a blocking member 400 and blocking member actuator such as ejector 420 which also functions to expel spent cartridges from pistol 20 after discharging the pistol; and a trigger assembly generally including a trigger 32, trigger bar 70, and hammer 34 mechanically linked together for operably coupled movement.

Grip frame 40 contains downwardly-open cavity 450 to removably and slidably receive a magazine 440 capable of holding and dispensing a plurality of cartridges 50 for automatic loading of pistol 20. The magazine disconnect mechanism is operably associated with magazine 440 and activated by a pistol user's actions of inserting the magazine into and removing the magazine from pistol 20, as explained below.

Figure 12:
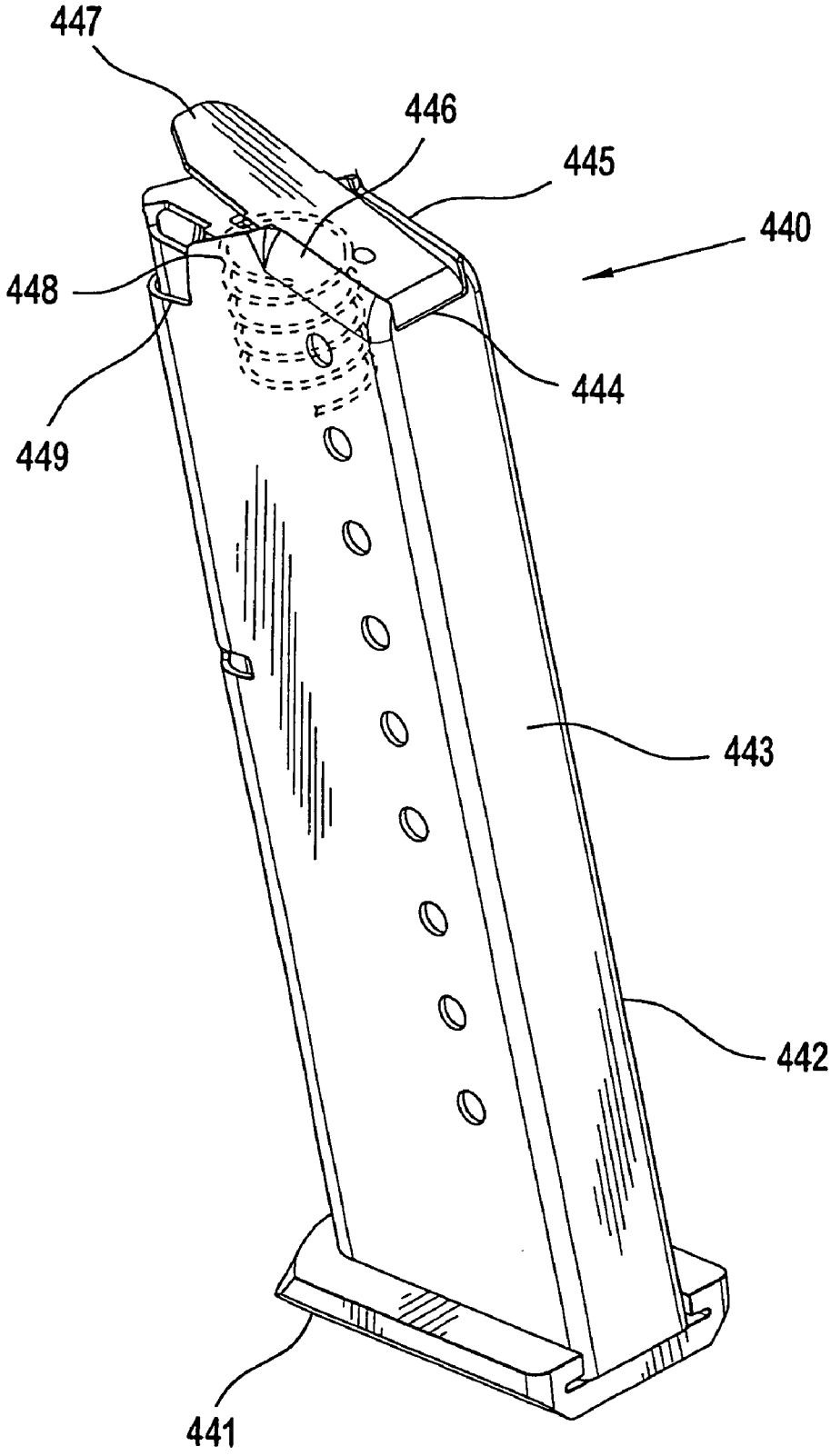
FIG. 12 is a perspective view of the magazine of the pistol of FIG. 1.

As shown in FIG. 12, magazine 440 includes a base 441 with a generally hollow rectangular tube 442 extending upwards from base 441 and which preferably has a top opening 449 through which cartridges 50 may be loaded. Magazine tube 442 has a rear wall 443 which in the preferred embodiment makes operable contact with ejector 420 to displace blocking member 400 in an upward direction. At the top of tube 442 in rear wall 443 is a notch 444 flanked on each side by an upward projection 445, 446 as shown. Upward projections 445, 446 may also make operable contact with ejector 420 when magazine 440 is inserted into pistol 20. A spring-loaded follower 447 having a follower spring, diagrammatically represented by helical spring 448 for purposes of illustration, is housed and slidably movable inside tube 442. Spring 448 may be any suitable type of spring. Follower 447 is biased in an upwards direction and dispenses cartridges 50 for automatic reloading of pistol 20. Magazine 440 may be inserted and removed from grip frame cavity 450 as shown by directional arrow 452 (see, e.g., FIG. 8) to fill and refill the magazine with cartridges 50.

Figure 7:
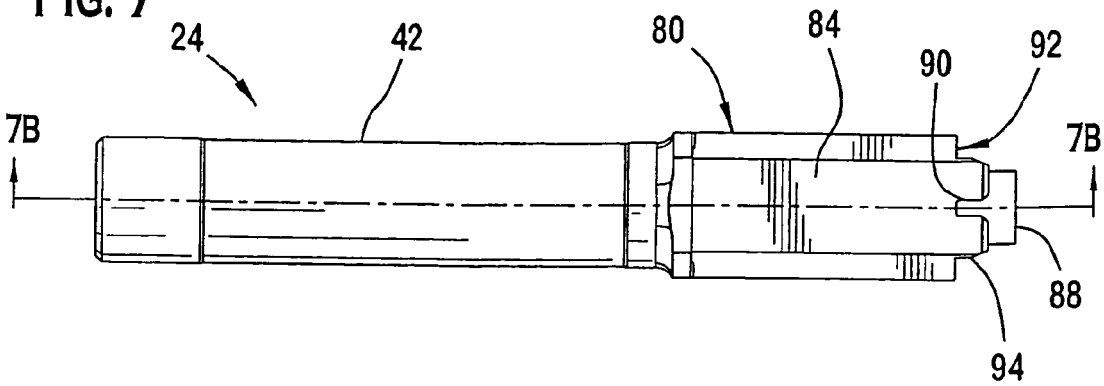
FIG. 7 is a top view of the barrel unit of the pistol of FIG. 1.
Figure 7A:
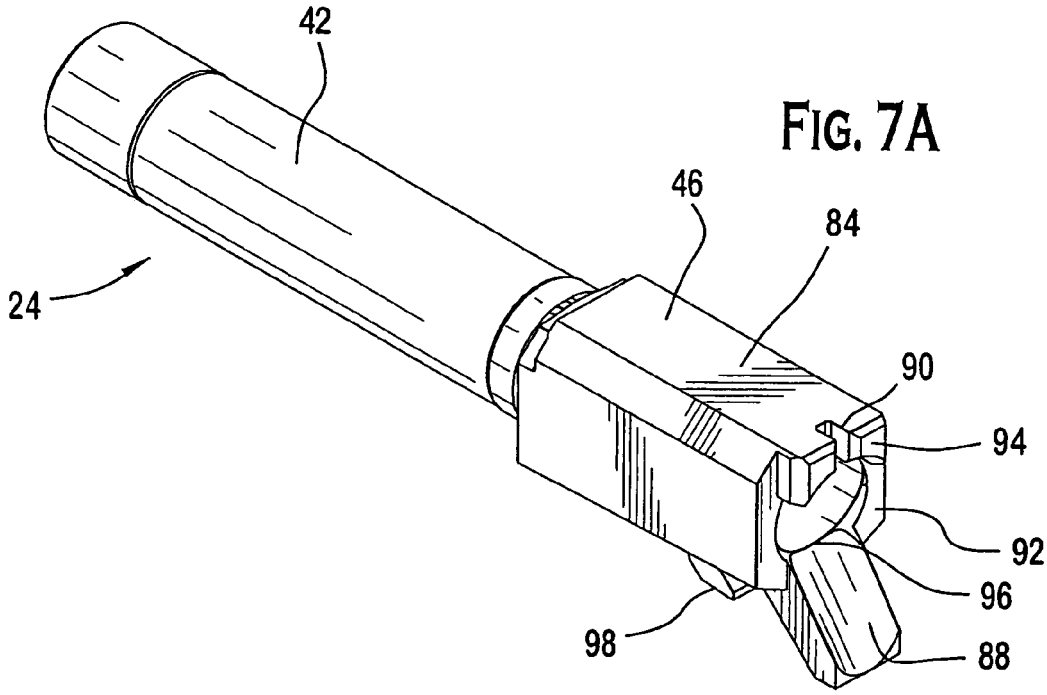
FIG. 7A is a rear perspective view of the barrel unit of the pistol of FIG. 1.
Figure 7B:
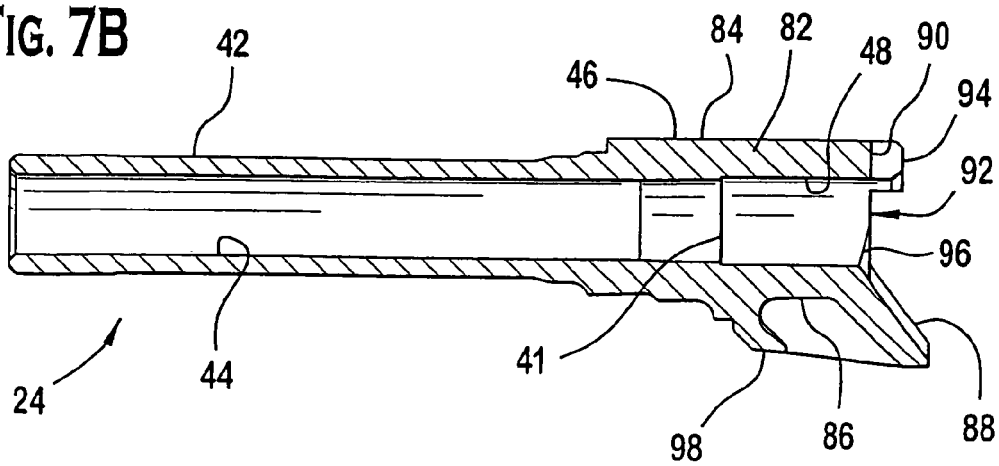
FIG. 7B is a cross-sectional view of the barrel unit of the pistol of FIG. 1 taken along line 7B-7B in FIG. 7.

Referring to FIGS. 7, 7A, and 7B, barrel unit 24 includes a barrel 42 having a barrel bore 44 and chamber block 46 at the rear end of barrel unit 24. Chamber block 46 may be integral with barrel 42 or a separate component connected to barrel 42. In one embodiment, barrel unit 24 is preferably disposed at least partially inside slide 22. It will be noted that chamber block 46 may have any suitable overall size and three-dimensional shape (e.g., rectangular or square block, cylindrical, etc.) so long as the chamber block is capable of fitting inside slide 22. In a preferred embodiment, chamber block 46 is rectangular in shape. Chamber block 46 may preferably, but not necessarily, have outside dimensions in cross-section that are larger than barrel 42, as shown.

Chamber block 46 defines and includes a chamber 48 which in a preferred embodiment may be a cylindrical bore that is concentrically aligned with barrel bore 44. Chamber 48 is sized and configured to receive and hold a cartridge 50, which in one embodiment of pistol 20 may be loaded forward in pistol 20 from a magazine 440 in preparation for firing. After firing, the spent cartridge casing is extracted rearwards from chamber 48 and ejected from pistol 20.

Barrel bore 44 and chamber 48 collectively define a longitudinal axis "LA" for pistol 20 including slide 22 that coincides with an axial centerline extending through bore 44 and chamber 48. The term "longitudinal" as used herein indicates an orientation and/or a direction parallel to but not necessarily concentric with longitudinal axis LA. A transverse axis "TA" is defined perpendicular to the longitudinal axis LA. The term "transverse" as used herein indicates a direction parallel to the transverse axis TA. The term "lateral" as used herein indicates an orientation and/or direction parallel to the transverse axis TA and towards either side of pistol 20.

A rearwardly-facing rear breech surface 92 surrounding chamber entrance 96 is provided. Rear breech surface 92 may include an upper rear projection 94 extending rearwardly in a longitudinal direction therefrom and disposed above chamber entrance 96. Upper rear projection 94 serves to provide clearance space 160 between rear breech surface 92 and breech face 116 of slide 22 to accommodate annular rim 56 and extractor groove 58 of cartridge 50 (see FIG. 3).

As best shown in FIG. 3, a cartridge 50 useable with the preferred embodiment may include a casing 52, a projectile 53 disposed in casing 52, a base 54, an annular rim 56 at the base, and an extractor groove 58. Headspace surface 55 at the top edge of casing 52 is stepped in shape and corresponds with a mating step-shaped headspacer 41 in chamber 48 to stop cartridge 50 in a fully-seated position when loaded in chamber 48 (see FIG. 2). Cartridge base 54 may have a primer cup 51 disposed in the center of base 54 which contains the primer material in the case of a centerfire-type cartridge. The primer cup is struck by firing pin 130 to discharge pistol 20. Depending on the specific type of cartridge being used, rim 56 may have a diameter that is smaller than the diameter of casing 52 (reduced or rebated rim cartridge), the same size (rimless cartridge), or larger (rimmed cartridge).

Figure 4:
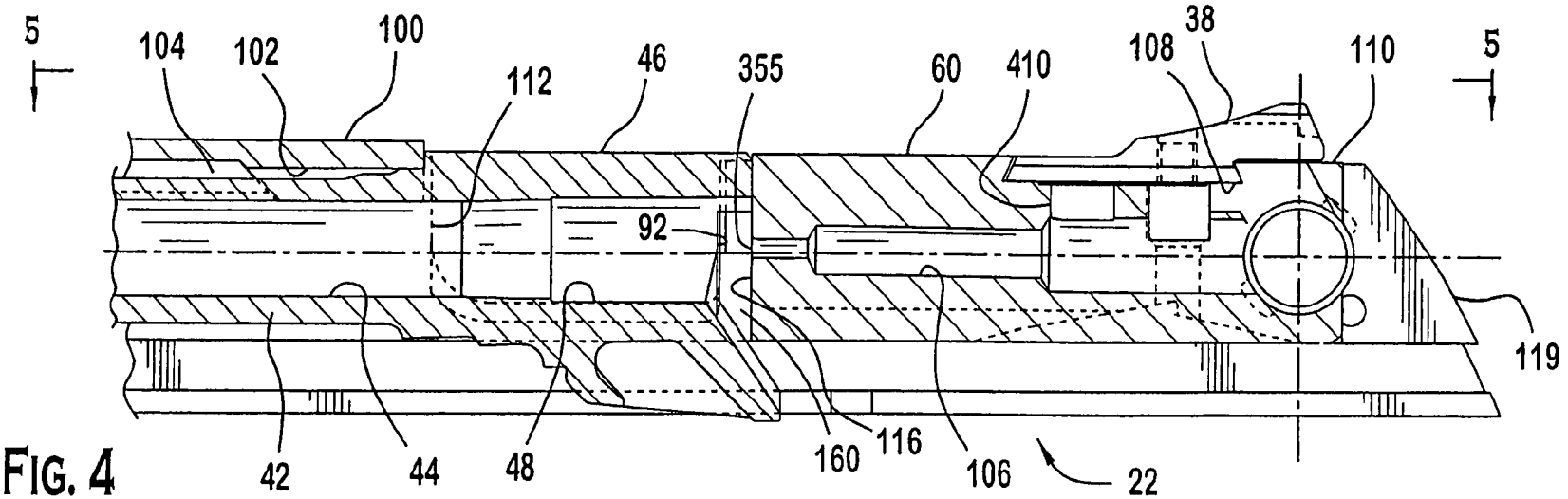
FIG. 4 is a side elevation view of the pistol of FIG. 1 showing the housing and barrel unit.
Figure 5:
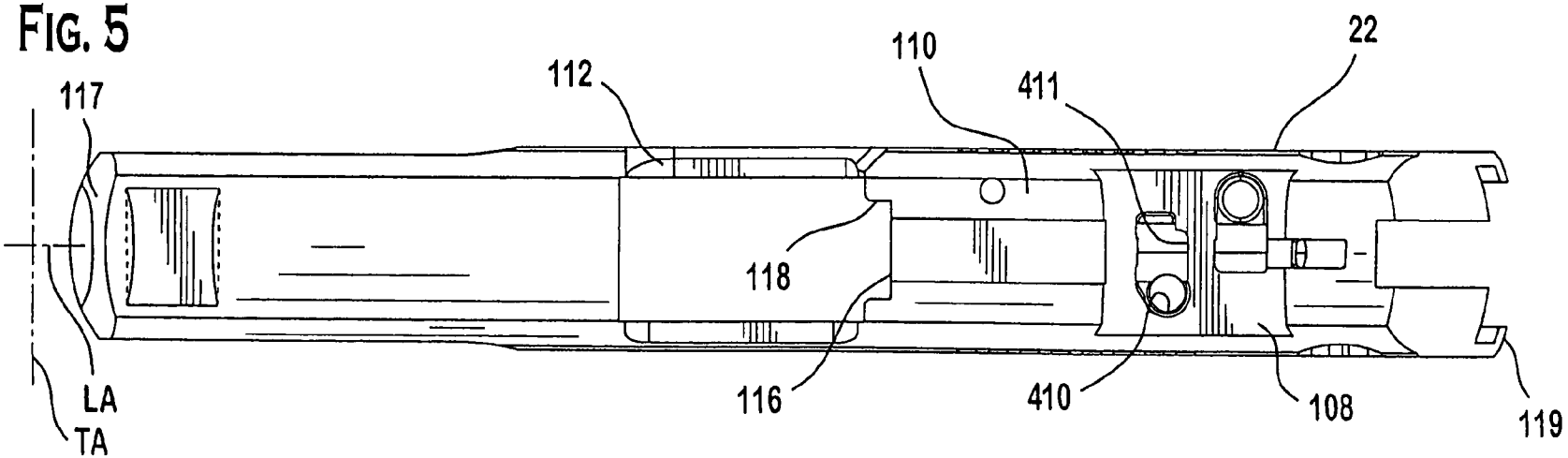
FIG. 5 is a top view of the pistol of FIG. 1 shown with the rear sight removed.

Referring generally to FIGS. 1-2, and with specific emphasis on FIGS. 4-5, slide 22 has a front end 117 (barrel end) and a rear end 119 (hammer end). In one embodiment, slide 22 may be slidably mounted on frame 26 via a rail system (not shown) and is biased in a forward direction preferably by a recoil spring 158. Slide 22 slidably reciprocates in a forward and rearward axial direction in response to recoil forces developed in discharging pistol 20 and the spring return force. During its rearward motion, slide 22 permits a spent cartridge casing 52 (i.e., after discharging pistol 20) to be ejected and a new cartridge 50 to be uploaded from the magazine. A new cartridge 50 is loaded into the chamber by slide 22 during its forward return motion.

Slide 22 may be partially hollow in structure and include a plurality of external surfaces 100 and internal surfaces 102. In the forward portion of slide 22, internal surfaces 102 define a downwardly-open forward internal cavity 104 to house at least a part of barrel unit 24 which is in operational relationship with slide 22. Preferably, barrel unit 24 is slidably received in slide 22 such that slide 22 and barrel unit 24 may move independently from each other for purposes to be explained below in conjunction with the operation of pistol 20. The rear portion of slide 22 contains a forwardly-facing breech face 116 which abuts and supports base 54 of cartridge 50 when the cartridge is loaded in chamber 48. Breech face 116 may have a breech face notch 118 which receives upper rear projection 94 projecting rearwardly from chamber block 46 and above chamber 48, as described above. In conjunction with upper rear projection 94, breech notch 118 serves to close up the area to the rear of chamber 48 when chamber block 46 is positioned in ejector port 112 such as when a cartridge is fully chambered and readied for firing.

Slide 22 may further include an external top surface 110, which constitutes part of slide external surfaces 100, and may extend substantially along the entire length of slide 22. A generally flat and wide horizontal landing surface 108 may be provided near the rear of top surface 110 to mount rear sight 38 on slide 22. An ejector port 112 may also be provided which extends laterally and downwardly through slide 22, and opening into internal cavity 104. When pistol 20 is in the ready position for firing with cartridge 50 loaded in chamber 48 (see, e.g., FIG. 2), chamber 48 is visible through and substantially blocks ejector port 112. When slide 22 is forced rearwards by firing pistol 20, ejector port 112 moves beyond chamber 48 and opens allowing a spent cartridge casing to be ejected through port 112.

Slide 22 further includes a firing pin cavity 106 configured to receive firing pin 130. In one embodiment, firing pin cavity 106 preferably is concentrically aligned with and shares longitudinal axis LA and a common centerline passing through the centerline of chamber 48 and bore 44. When cartridge 50 is loaded in chamber 48, this aligns firing pin 130 to strike the center of cartridge base 54 where the primer cup 51 is located to discharge pistol 20 (see FIG. 3). Firing pin cavity 106 preferably matches the shape of firing pin 130, and in one embodiment as shown may include several adjoining cavities having different internal diameters to accommodate the shape of firing pin 130. The rear of firing pin cavity 106 is open to allow rear hammer end 241 of firing pin 130 (see FIG. 14) to be positioned for being struck by hammer 34 to discharge pistol 20. The front of firing pin cavity 106 has an opening 355 (see FIG. 4) which allows striking end 240 of firing pin 130 to be protruded outwards from cavity 106 to contact cartridge 50 when struck by hammer 34.

Figure 14A:
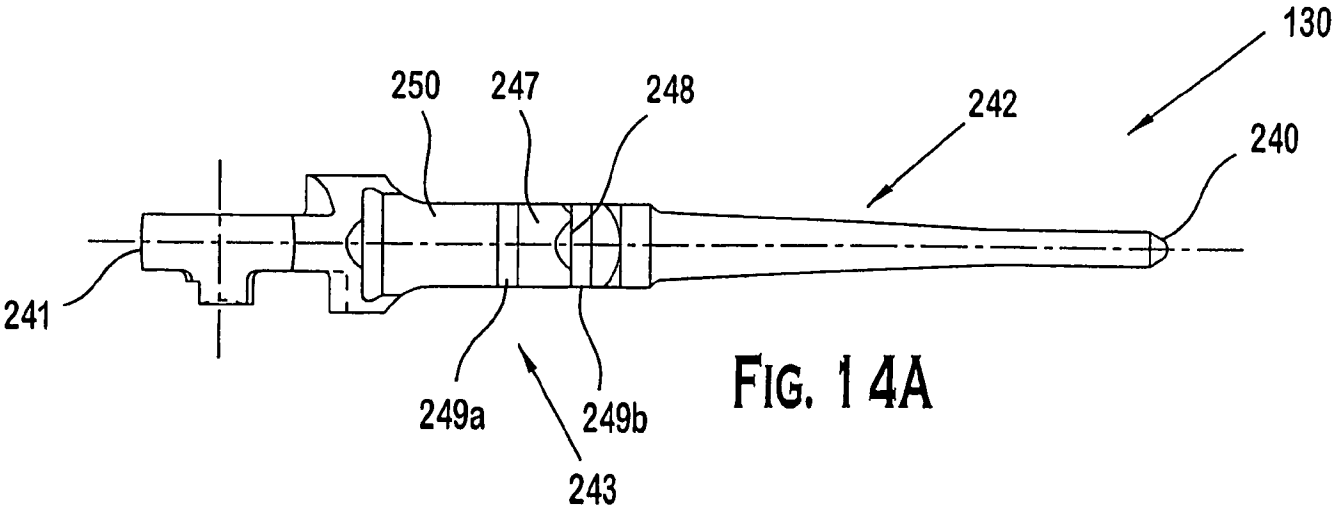
FIG. 14A is a top view of the firing pin of the pistol of FIG. 1.
Figure 14B:
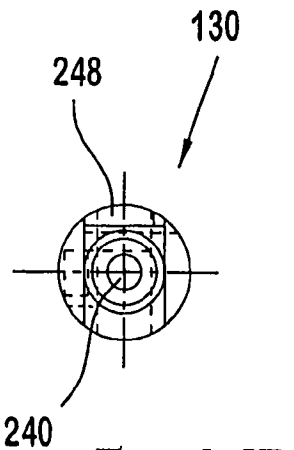
FIG. 14B is a front view of the firing pin of the pistol of FIG. 1.
Figure 14:
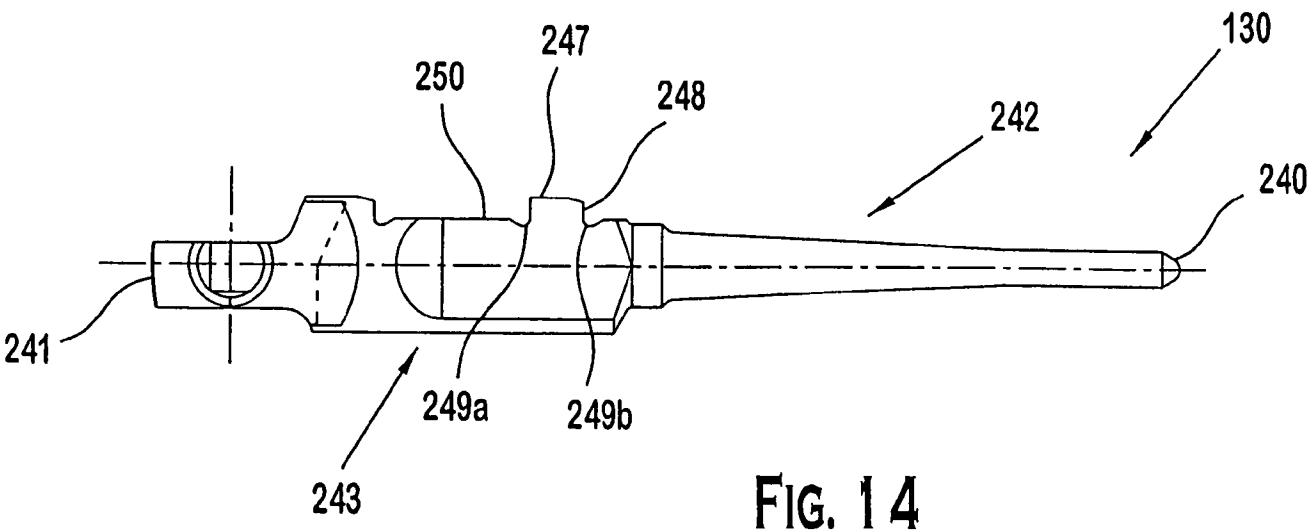
FIG. 14 is a right side view of the firing pin of the pistol of FIG. 1.

Referring specifically to FIGS. 14-14B, firing pin 130 includes front cartridge-striking end 240, preferably culminating in a tip to strike primer cup 51 of cartridge 50, and a rear hammer end 241. In one embodiment as shown, the front portion of firing pin 130 has a generally tapered, cylindrical section 242 transitioning into striking end 240. Rear of cylindrical section 242 is a preferably enlarged section 243 containing top surface 250 which includes upwardly-extending protrusion 247 rising therefrom. Protrusion 247 has a forward-facing vertical surface 248 configured and sized for abutting contact with rearward-facing surface 406 of blocking member 400 to prevent forward movement of firing pin 130. Preferably, vertical surface 248 is shaped cooperatively with blocking member surface 406 to produce a positive blocking relationship firing pin 130 and blocking member 400. In one embodiment, vertical surface 248 may be substantially flat as shown, but other suitable configurations are possible so long as vertical surface 248 positively engages blocking member 400 to arrest forward movement of firing pin 130. Top surface 250 of firing pin 130 may have a laterally-extending undercuts 249*a*, 249*b* at the base of and immediately forward and rearward of protrusion 247, as shown.

Firing pin 130, preferably disposed in firing pin cavity 106 of slide 22 as noted above, may be biased by a spring 170 in a rearward direction opposite chamber 48. In one embodiment, spring 170 is a helical spring which is preferably coiled around cylindrical section 242 (see FIG. 2). Firing pin 130 preferably has a longitudinally reciprocating forward stroke and rearward motion (see, e.g., FIG. 8 directional arrow 451), and is mechanically actuated by trigger 32. Hammer 34 is operably linked to trigger 32 by a pivoting sear (not shown) that is engaged by trigger bar 70 and holds the hammer in a cocked rearward position, as shown in FIG. 2. Trigger bar 70 is preferably slidably received in frame 26 and capable of a reciprocating forward/backward longitudinal axial movement with respect to the frame. In general, pulling trigger 32 pivots the sear and releases hammer 34 which moves or falls forward from the ready-to-fire position (as shown in FIG. 2) to strike the rear of firing pin 130. Firing pin 130 is forced forward through firing pin cavity 106 against the spring force of spring 170 and strikes the cartridge primer cup 51 to set off the charge and discharge pistol 20.

Referring to FIGS. 6-6C, pistol 20 includes a blocking member 400 operably associated with the magazine disconnect mechanism. Blocking member 400 preferably is moveable in position into and out of engagement with firing pin 130 in response to the absence or presence of magazine 440 in the pistol 20. More specifically in one embodiment, blocking member 400 is actuated by ejector 420 which is positioned to be operably engaged by magazine 440 in response to insertion and removal of the magazine from pistol 20.

Figure 8:
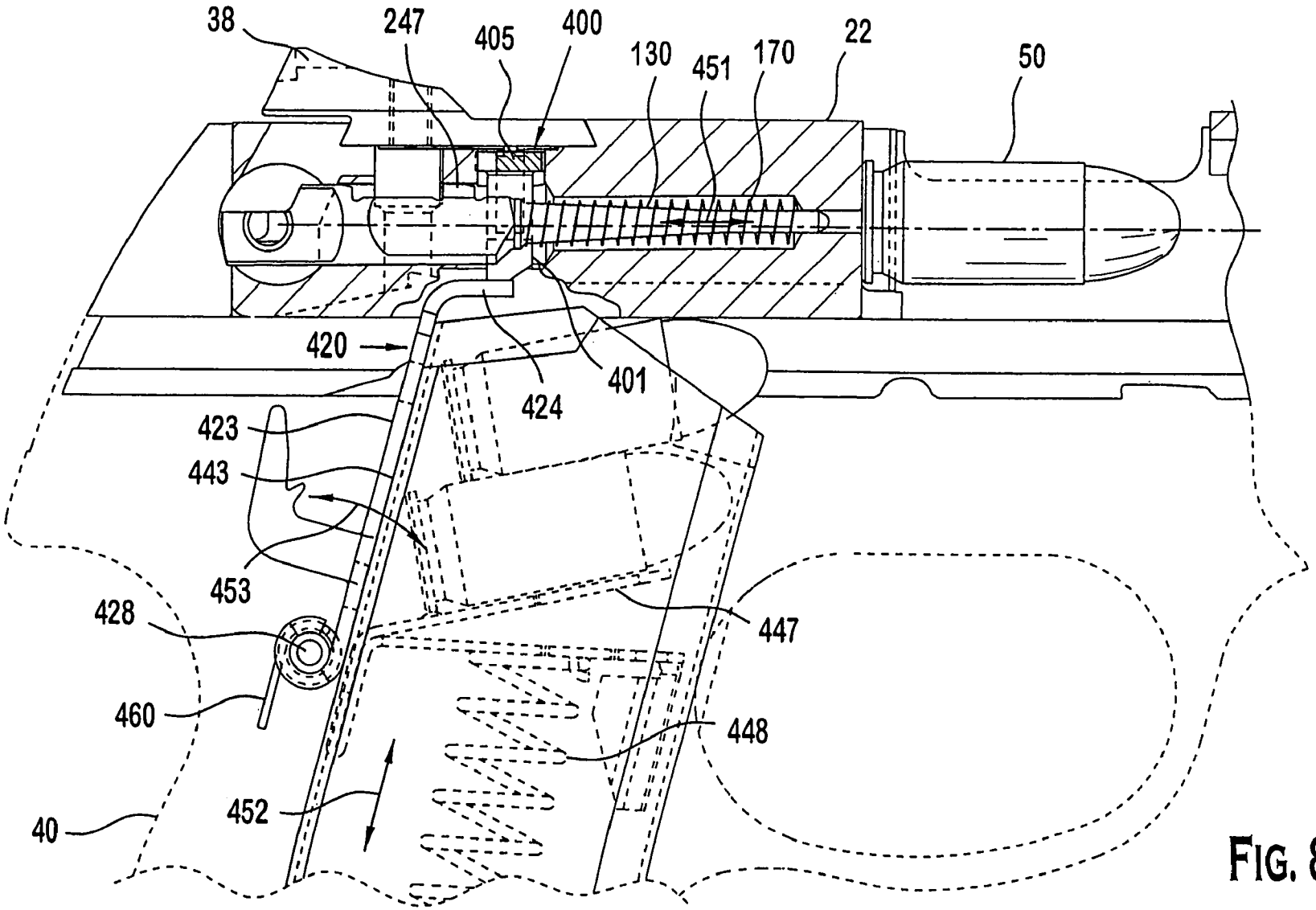
FIG. 8 is a right side elevational cutaway view of the housing of the pistol of FIG. 1 showing the magazine and ejector disembodied, and top portion of the magazine in a fully inserted position.
Figure 11:
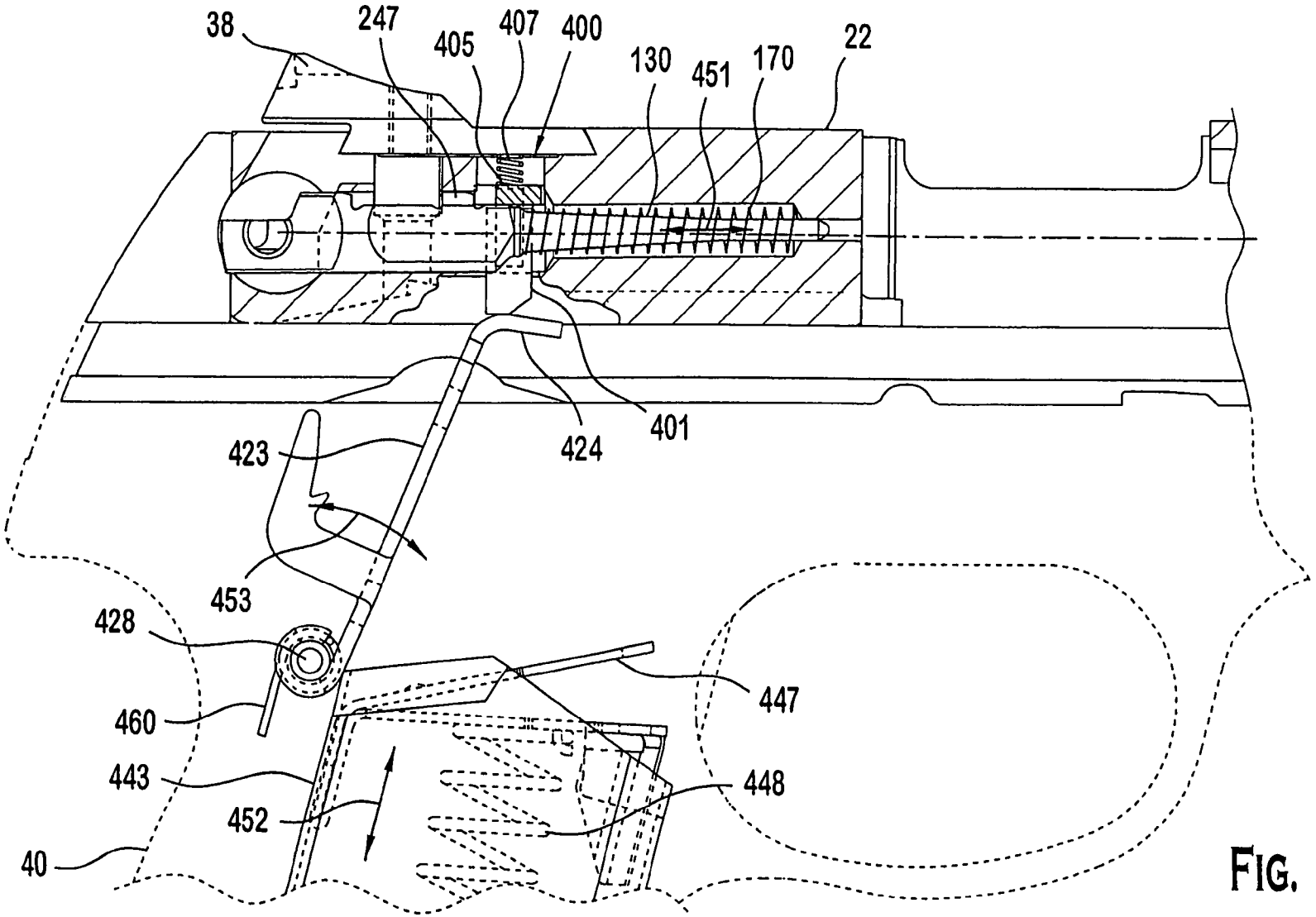
FIG. 11 is a right side elevational view of the housing of the pistol of FIG. 1 showing the magazine and ejector disembodied, and top portion of the magazine in a partially removed position.

In the preferred embodiment, blocking member 400 is movable from a first position disengaged from firing pin 130 when magazine 440 is present and inserted in pistol 20 (as shown in FIG. 8), to a second position engaged with firing pin 130 when magazine 440 is absent and removed from pistol 20 (as shown in FIG. 11). The first position may be equated with a "non-blocking" or "ready-to-fire" position of blocking member 400 because firing pin 130 is freely movable in response to a strike by hammer 34. The second position may be equated with a "blocking" or "safe" position because full forward motion of firing pin 130 needed to strike cartridge 50 and discharge pistol 20 is blocked by blocking member 400. Preferably, when mounted in pistol 20, blocking member 400 in one embodiment is vertically movable between the first and second positions. In the preferred embodiment, blocking member 400 is configured and arranged to engage protrusion 247 on the top of firing pin 130, thereby arresting or blocking the forward movement of firing pin 130 to preferably prevent the firing pin from striking the cartridge and discharging the pistol.

With continuing reference to FIGS. 6-6C, magazine disconnect blocking member 400 preferably includes a mounting portion in the form of a generally cylindrical shaft 401 and a firing pin engagement portion in the form of substantially planar flange 405 preferably disposed perpendicular to the shaft and laterally extending therefrom. When mounted in pistol 20, shaft 401 is preferably oriented in a vertical direction, and positioned proximate and lateral to the firing pin 130 so that flange 405 extends laterally over firing pin 130 to engage upwardly-extending protrusion 247 on the top of firing pin 130.

Flange 405 may have a free end 408 distal to mounting shaft 401 and an opposite end 409 proximate to shaft 401. Flange 405 preferably includes a substantially flat rearward-facing surface 406 to contact and blockingly engage forward-facing surface 248 on upwardly-extending protrusion 247 of firing pin 130. If firing pin 130 attempts to move in a forward direction to strike cartridge 50 when blocking member 400 is in the second position engaged with firing pin 130, mutual contact between surfaces 406 and 248 blocks the forward movement of the firing pin short of striking the cartridge.

Shaft 401 may be slidably received in vertically-oriented cylindrical hole 410 disposed in slide 22 as shown in FIG. 5, and preferably is capable of upward and downward reciprocating vertical motion inside hole 410 such that blocking member 400 may move like a piston within the hole. Hole 410 is preferably disposed in landing surface 108 on top surface 110 of slide 22. A cutout 411 is further provided which opens down into the firing pin cavity 106 in slide 22 to allow blocking member flange 405 to operably engage firing pin 130. Cutout 411 is sufficiently sized and configured to receive and accommodate the size and shape of flange 405. In one embodiment as shown, hole 410 is preferably positioned in slide 22 offset from the centerline of firing pin cavity 106, but proximate to firing pin cavity 106 such that flange 405 is positioned close enough to engage firing pin 130. When shaft 401 is located in hole 410 of slide 22, flange 405 is preferably oriented to extend in a lateral direction towards firing pin 130. Also preferably, hole 410 has an open bottom such that at least part of shaft 401 may be projected downwards beyond the hole to be operably engaged by ejector 420. Flange 405 which makes abutting contact with the top surface of slide 22 beyond the perimeter of hole 410 and the extent to which shaft 401 projects beyond and below hole 410 may be regulated by selecting an appropriate length for shaft 401.

A cylindrical recess 404, which preferably opens through flange 405, may be provided in shaft 401 to receive a biasing member such as helical spring 407 (see FIG. 6). When blocking member 400 is mounted in pistol 20, spring 407 biases blocking member 400 in a downward direction into blocking engagement with firing pin 130 (see FIG. 1). Spring 407, through contact with ejector 420 as shown in FIG. 11, also urges ejector 420 downwards when magazine 440 is not present in grip frame 40. When mounted in pistol 20, spring 407 may be trapped in slide 22 by the bottom surface 144 of rear sight 38 (see FIG. 13) when sight 38 is installed on slide landing surface 108 (see FIG. 2). Preferably, spring 407 may contact bottom surface 144 of rear sight 38 directly.

Blocking member shaft 401 may have a step 402 along its length if required to avoid interference with various other internal pistol components. The bottom 412 of shaft 401 also preferably includes a downwardly inclined angled surface 403 which faces in a forward direction, for reasons discussed below after description of ejector 420.

As shown in FIGS. 15-15C, a blocking member actuator such as ejector 420 in the preferred embodiment may be a flat rectangular plate having a somewhat elongated main body 423 with various appurtenances. Ejector 420 includes a lower rolled portion 421 defining a circular opening 422 to receive pin 428 for pivotal pinned attachment transversely in grip frame 40. Accordingly, pivot pin 428 defines a pivot point for ejector 420. The upper portion of main body 423 includes a forwardly-extending elongate lever arm 424 sized and configured to contact the bottom of blocking member 400 (see, e.g., FIGS. 8 and 11). Lever arm 424 is preferably offset to one of the left or right sides 425, 426 respectively of ejector 420. In one embodiment, lever arm 424 is offset towards left side 425 to coincide in position with the preferred location of blocking member 400 in slide 22. Lever arm 424 may be disposed at an angle 427 formed between lever arm 424 and main body 423. Preferably, angle 427 is selected so that lever arm 424 is oriented generally parallel to the longitudinal axis LA of pistol 20 when magazine 440 is inserted so that lever arm 424 squarely contacts the bottom 412 of blocking member 400, as shown in FIG. 15. In one embodiment, angle 427 is preferably about 75 degrees. Lever arm 424 preferably has a curved transition portion 429 as shown in FIG. 15 to provide smooth movable engagement with blocking member 400, as explained below.

Ejector 420 is preferably mounted to and positioned in grip frame 40 as shown in FIG. 2. Ejector 420 may have a generally inclined vertical orientation as mounted in the preferred embodiment. Preferably, ejector 420 is pivotally and arcuately movable in a forward and rearward direction (clockwise and counter-clockwise about pin 428 respectively, with reference to orientations shown in FIGS. 8 and 11), as shown by directional arrow 453.

Ejector 420, which preferably serves as an actuator for blocking member 400, controls the position and movement of blocking member 400. Preferably, ejector 420 is activated and movable both in response to contact by magazine 440 when magazine 440 is inserted into grip frame 40 of pistol 20, and in response to breaking contact with magazine 440 when the magazine is removed from grip frame 40. Accordingly, as shown by directional arrow 453, ejector 420 may move in two opposite directions with the direction depending on whether magazine 440 is being inserted or removed from pistol 20. When magazine 440 is inserted into, the magazine abuttingly contacts and rotates ejector 420 in a rearward and upward direction. When fully seated in grip frame 40, magazine 440 supports and holds ejector 420 in an upper position. When magazine 440 is removed from pistol 20, contact is broken between the magazine and ejector 420. The now unsupported ejector 420 moves forward and downward to a lower position.

Ejector 420 may be biased upwards and rearwards in a counter-clockwise direction (when viewed as in FIGS. 8 and 11) by a biasing member such as spring 460 that facilitates ejecting a spent cartridge from pistol 20. Conversely, biasing spring 407 biases blocking member 400 downwards in the preferred embodiment opposing the upwardly-urged ejector 420. Accordingly, the spring force (k) of blocking member spring 407 is preferably selected to overcome the spring force (k) of the ejector spring so that ejector 420 may be displaced downwards by spring-biased blocking member 400 when magazine 440 has been removed from pistol 20 and ejector 420 is no longer vertically supported by the magazine.

Although in the preferred embodiment the ejector 420 has a generally flat and rectangular shape, it will be appreciated that other suitable shapes are possible so long as the ejector is configured to operably engage and move blocking member 400 into and out of engagement with the firing pin 130 in response to inserting and removing magazine 440 into and from pistol 20.

It should be noted that although the ejector preferably serves as the blocking member actuator in the preferred embodiment, a separate blocking member actuator may be provided and is contemplated. Accordingly, the invention is not limited in that regard.

When pistol 20 is discharged, ejector 420 remains relatively stationary in longitudinal position within pistol 20, while blocking member 400 travels an appreciable distance along the longitudinal axis by contrast. The interaction between these two components after a cartridge is discharged will be briefly described to clarify the function of features previously described for each.

When pistol 20 is discharged, recoil forces cause slide 22 carrying blocking member 400 mounted therein to slidably travel rearward in a guided fashion on frame 26 via a rail system (not shown). Contact is broken between blocking member 400 and ejector 420, thereby causing blocking member 400 to move downwards and assume a blocking position (i.e., the second position note above) wherein firing pin 130 is engaged by the blocking member (see position shown in FIG. 11). By contrast, ejector 420, being pivotally connected to grip frame 40 as described below, remains stationary in longitudinal position and forward of blocking member 400. When slide 22 is returned forward by the urging effect of recoil spring 170, the front of blocking member shaft 401 rapidly contacts the rear of lever arm 424 on ejector 420 with appreciable force, thereby forcing blocking member 400 back upwards into its first position wherein blocking member 400 is disengaged from firing pin 130. Forward facing angled surface 403 facilitates smooth and gradual contact between blocking member 400 and ejector 420 to prevent binding of slide 22 during its forward return motion. Curved portion 429 on ejector lever arm 424 also facilitates smooth contact with blocking member 400 during its forward return motion and re-engagement with ejector 420.

With reference now to FIGS. 13 and 13A, rear sight 38 is preferably mounted to horizontal landing surface 108 in top surface 110 of slide 22 (see FIG. 2). Rear sight 38 has a top surface 142, bottom surface 144, rear end 145, and a front sloping surface 146. The intersection of surfaces 144 and 146 define a leading edge 148. When rear sight 38 is mounted in pistol 20 as shown in FIG. 2, bottom surface 144 contacts spring 407 directly if a plunger is not provided. Rear sight 38 further includes a top sighting surface 143 which in one embodiment is preferably recessed below spaced-apart peak surfaces 147 at the rear of sight 38. Preferably, rear sight 38 may be primarily mounted to landing surface 108 of slide 22 via a press-fit dovetail. A threaded fastener (not shown) is insertable through threaded fastener hole 141 in rear sight 38 which abuts landing surface 108 as added security.

Operation of the magazine disconnect mechanism of pistol 20 will now be described with primary reference to FIGS. 8-11.

FIG. 8 depicts blocking member 400 in the first (non-blocking) position or "ready-to-fire" position. Blocking member 400 is not engaged with firing pin 130 which is free to move fully forward in response to a hammer 34 strike. This allows firing pin 130 to strike a chambered cartridge 50, thereby discharging pistol 20. Magazine 440 is shown fully inserted in grip frame 40 and positioned to dispense cartridges to pistol 20 as needed. Ejector 420 is in contact with and vertically supported by rear wall 443 of magazine 440 which holds the ejector upwards against the downward urging force produced by blocking member spring 407. Ejector 420 is in a first rearward and upper position. Lever arm 424 on ejector 420 is in contact with bottom 412 of blocking member shaft 401 which holds blocking member 400 upwards in the first position (see FIG. 8).

Figure 9:
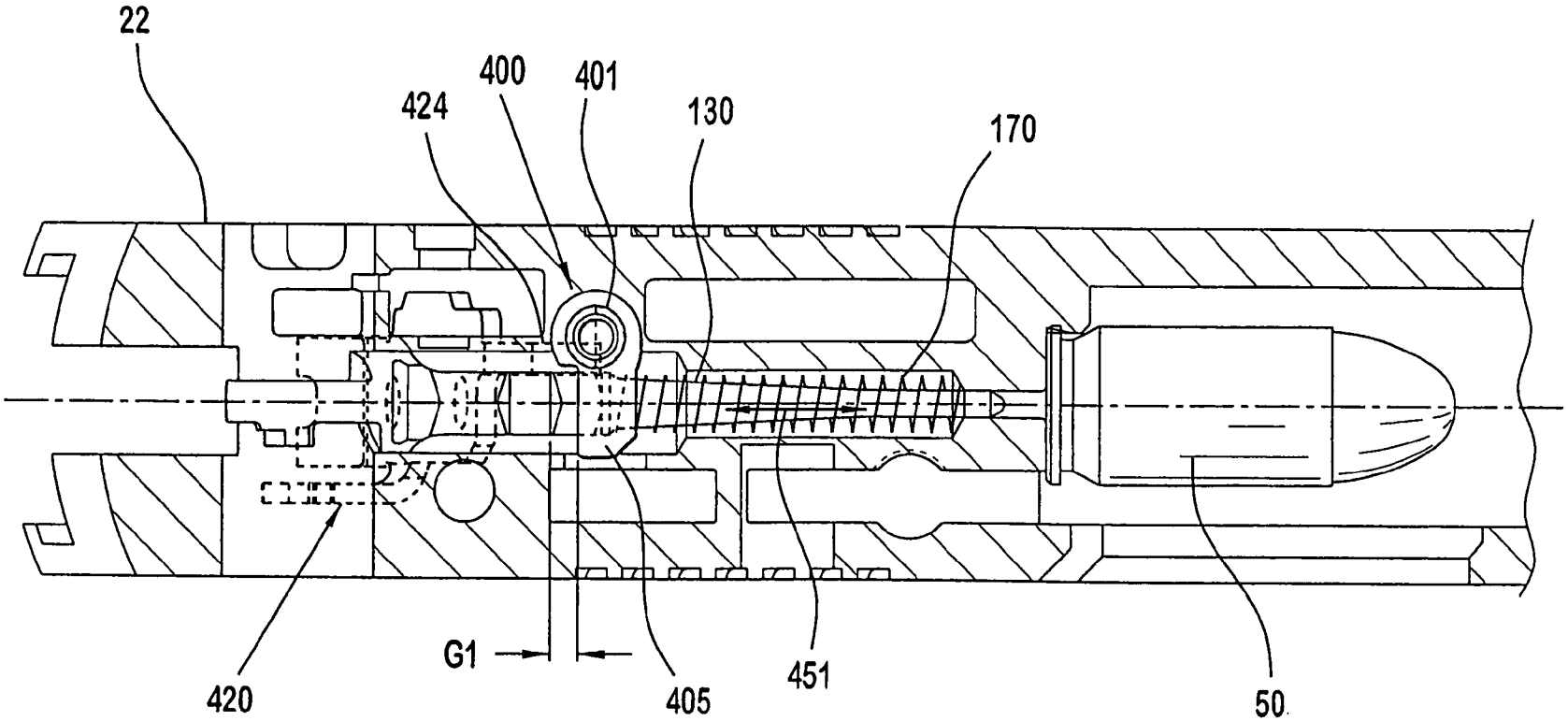
FIG. 9 is a top cutaway view of the pistol of FIG. 1.
Figure 10:
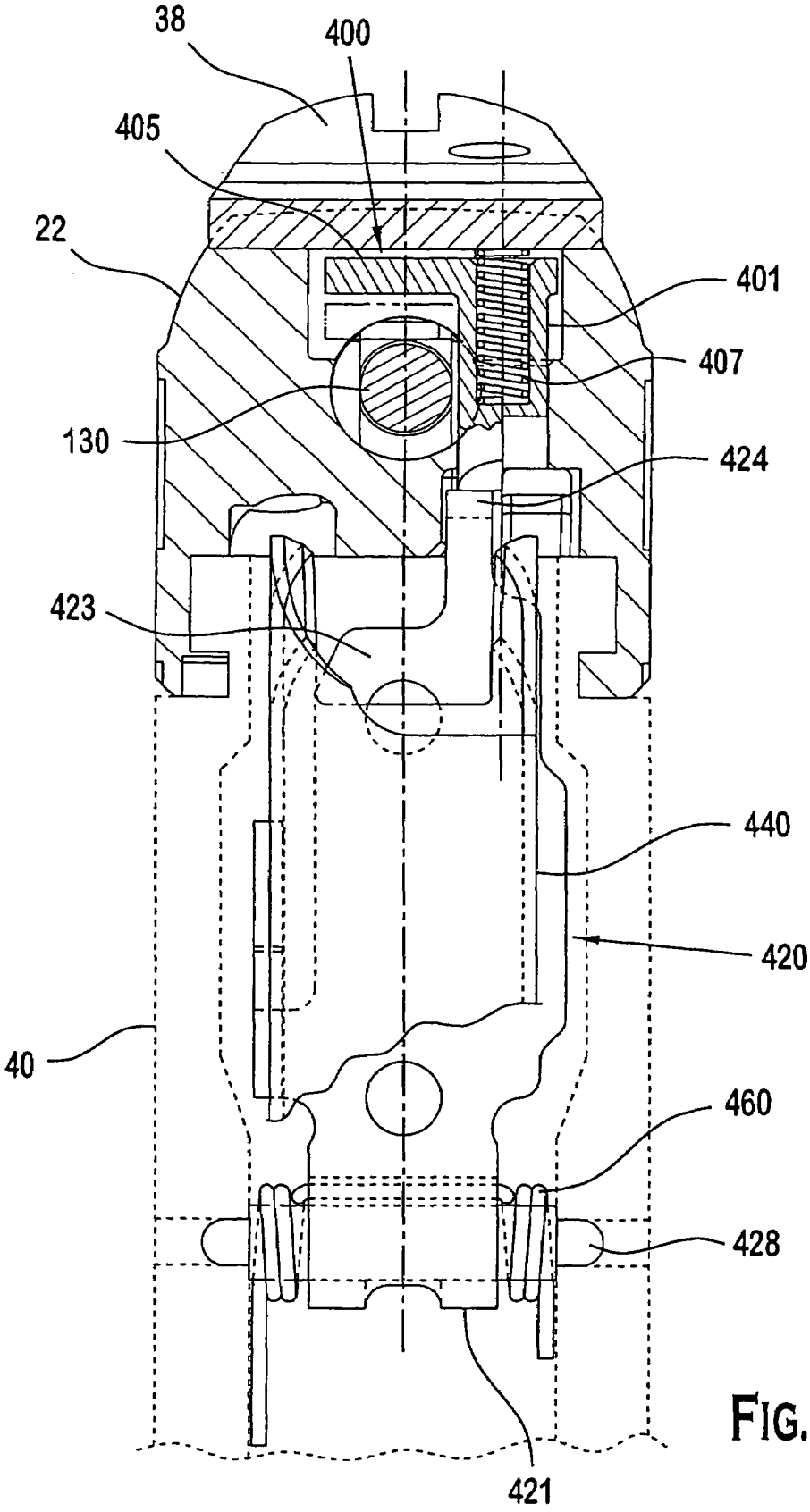
FIG. 10 is a front cutaway view of the pistol of FIG. 1.

As shown in FIG. 9 (a top view taken from FIG. 8 wherein rear sight 38 has been removed to clearly show the components below), blocking member flange 405 extends laterally from blocking member mounting shaft 401 over firing pin 130. In the first position shown in FIG. 9, flange 405 is positioned above firing pin 130 so that blocking member 400 does not engage firing pin 130. Ejector lever arm 424 is positioned below blocking member mounting shaft 401 on the left side of firing pin 130.

Referring now to FIG. 11 which depicts blocking member 400 in the second (blocking) or "safe" position, magazine 440 has been removed from pistol 20. Without magazine 440 present to support and hold ejector 420 upwards in the first rearward position noted above, ejector 420 is moved pivotally forward and downward to a second forward position (as shown) by blocking member 400 which is urged downwards by spring 407. Blocking member 400 is engaged with firing pin 130 which is blocked from moving forward a sufficient distance to strike cartridge 50 as needed to discharge pistol 20. This results from vertical contact surface 406 on blocking member flange 405 of blocking member 400 engaging corresponding vertical contact surface 248 on upward protrusion 247 of firing pin 130.

It should be noted that there is no requirement that firing pin surface 248 be in direct and abutting contact with opposing blocking member surface 406 in order to establish an effective blocking relationship between firing pin block 260 and firing pin 130. Accordingly, a small distance or gap "G1" (as shown in FIG. 9) between contact surface 248 of firing pin 130 and contact surface 406 of blocking member 400 is permissible, as is some limited forward travel of firing pin 130, provided that firing pin 130 cannot ultimately reach and strike cartridge 50 before these contact surfaces are stoppingly engaged with each other.

When magazine 440 is reinserted into grip frame 40 of pistol 20, the rear magazine wall 443 contacts ejector 420 to move the ejector upwards back to it first rearward position, as shown in FIG. 8. Concomitantly, ejector 420 contacts and pushes blocking member 400 back to its first unblocking position also shown in FIG. 8, wherein blocking member 400 is disengaged from firing pin 130 which is free to move forward to contact cartridge 50 and discharge pistol 20.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A method for blocking discharge of a firearm having a chamber for holding a cartridge, a firing pin slidably mounted in the firearm for forward axial movement towards the chamber to strike the cartridge, and a removable magazine, the method comprising:

removing the magazine from the firearm;

moving a blocking member towards the firing pin in response to removing the magazine, wherein removing the magazine lowers an actuating lever supporting the blocking member; and positioning the blocking member between a surface on the firing pin and the chamber to prevent the firing pin from striking a chambered cartridge and discharging the firearm.

2. The method of claim 1, wherein the blocking member comprises a shaft with a laterally-protruding flange that is positioned between the firing pin surface and the chamber in the positioning step.

3. The method of claim 1, wherein the firing pin surface protrudes upward from the firing pin.

4. A method for blocking discharge of a firearm, the method comprising:

providing a firearm including a chamber for holding a cartridge and defines a longitudinal axis, a firing pin concentrically aligned with the chamber and slidably mounted in the firearm for forward longitudinal movement towards the chamber, and a removable magazine;

removing the magazine from the firearm;

moving a blocking surface in a linear path towards the firing pin from a first vertical position above the firing pin to a second lower vertical position in response to removing the magazine;

positioning the blocking surface between a surface on the firing pin and the chamber; and blocking forward movement of the firing pin towards the chamber to prevent discharging the firearm.

5. The method of claim 4, wherein the surface on the firing pin surface protrudes upward from the firing pin.

6. The method of claim 4, wherein removing the magazine lowers an actuating lever supporting the blocking surface to move the blocking surface towards the firing pin.

7. The method of claim 6, wherein the blocking surface is positioned above the firing pin.

8. A method for blocking discharge of a firearm having a chamber for holding a cartridge, a firing pin slidably mounted in the firearm for forward axial movement towards the chamber to strike the cartridge, and a removable magazine, the method comprising:

removing the magazine from the firearm;

engaging a blocking member with the firing pin in response to removing the magazine;

positioning a blocking surface on the blocking member between a surface on the firing pin and the chamber such that forward axial movement of firma pin towards the chamber is blocked to prevent striking a chambered cartridge when the magazine removed from the firearm;

wherein the engaging step includes moving the blocking member in a downward vertical direction to engage the firing pin.

9. A method for blocking discharge of a firearm having a chamber for holding a cartridge, a firing pin slidably mounted in the firearm for axial longitudinal movement towards the chamber; and a removable magazine, the method comprising:

supporting an actuating lever in the firearm with the magazine;

supporting a blocking member in a first vertical position with the actuating lever;

removing the magazine from the firearm;

lowering the actuating lever;

moving the blocking member downwards to a second vertical position; and positioning a blocking surface on the blocking member between a surface on the firing pin and the chamber such that axial movement of firing pin towards the chamber is blocked to prevent striking a chambered cartridge when the magazine is removed from the firearm.

10. The method of claim 9, further comprising biasing the blocking member from the first vertical position towards the second vertical position.

11. The method of claim 9, further comprising biasing the actuating lever upwards towards the blocking member.

12. The method of claim 9, wherein the blocking surface is positioned above the firing pin.

* * * * *

UNITED STATES PATENT AND TRADEMARK OFFICE

CERTIFICATE OF CORRECTION

PATENT NO. : 7,581,345 B2
APPLICATION NO. : 12/074780
DATED : September 1, 2009
INVENTOR(S) : James McGarry It is certified that error appears in the above-identified patent and that said Letters Patent is hereby corrected as shown below:

Column 15, claim 8, line 1, change "firma" to --firing--

Signed and Sealed this

Sixth Day of October, 2009

David J. Kappos

David J. Kappos
*Director of the United States Patent and Trademark Office*